United States Patent [19]

Taguchi

[11] Patent Number: 4,940,393

[45] Date of Patent: Jul. 10, 1990

[54] SLANT PLATE TYPE COMPRESSOR WITH VARIABLE DISPLACEMENT MECHANISM

[75] Inventor: Yukihiko Taguchi, Maebashi, Japan

[73] Assignee: Sanden Corp., Japan

[21] Appl. No.: 295,733

[22] Filed: Jan. 11, 1989

[30] Foreign Application Priority Data

Jan. 13, 1988 [JP] Japan ..... 63-3684

[51] Int. Cl.[5] ..... F04B 1/28

[52] U.S. Cl. ..... 417/222

[58] Field of Search ..... 417/222, 222 S, 270.

[56] References Cited

U.S. PATENT DOCUMENTS

| | | | |
|---|---|---|---|
| 4,747,753 | 5/1988 | Taguchi | 417/270 X |
| 4,778,348 | 10/1988 | Kikuchi et al. | 417/222 S |
| 4,780,059 | 10/1988 | Taguchi | 417/270 X |
| 4,780,060 | 10/1988 | Terauchi | 417/270 |
| 4,842,488 | 6/1989 | Terauchi | 417/222 S |

FOREIGN PATENT DOCUMENTS

| | | | |
|---|---|---|---|
| 191673 | 8/1987 | Japan | 417/222 S |
| 90681 | 4/1988 | Japan | 417/222 S |

*Primary Examiner*—Leonard E. Smith

[57] ABSTRACT

A slant plate type compressor with a variable displacement mechanism is disclosed. The compressor includes a housing having a cylinder block provided with a plurality of cylinders and a crank chamber. A piston is slidably fitted within each cylinder and is reciprocated by a drive mechanism including a slant plate having a surface with an adjustable inclined angle. The inclined angle is controlled by the pressure within the crank chamber to control the capacity of the compressor. The pressure in the crank chamber is further controlled by a control mechanism which includes two passageways linking the crank chamber with the suction chamber, each passageway having a valve control device to control the opening and closing of the passageway. The first valve control device controls the first passageway in response to the suction chamber pressure at a third control point. The second valve control device controls the second passageway in response to the suction chamber pressure at a first control point and at a second control point such that the passageway is open when the pressure exceeds the second control point and the passageway is closed when the suction pressure is below the first control point. The first control point is less than the third control point which is less than the second control point. The second valve control device includes a deformable plate hysterically responsive to the suction chamber pressure to switch between two shapes to control the link.

16 Claims, 7 Drawing Sheets

SLANT PLATE TYPE COMPRESSOR WITH VARIABLE DISPLACEMENT MECHANISM

BACKGROUND OF THE INVENTION

1. Technical Field

The present invention relates to a refrigerant compressor, and more particularly, to a slant plate type compressor such as a wobble plate compressor having a variable displacement mechanism suitable for use in an automotive air-conditioning system.

2. Description of the Prior Art

Slant plate type piston compressors provided with a displacement or capacity adjusting mechanism to control the compression ratio of the compressor in response to demand are known in the art. As disclosed in U.S. Pat. No. 3,861,829, the compression ratio may be controlled by changing the slant angle of the sloping surface of the slant plate in response to the operation of a valve control mechanism. The slant angle of the slant plate is adjusted in repsonse to a change in suction chamber pressure to restore the suction chamber pressure to a constant level.

The construction of a slant plate type compressor, specifically a wobble plate type refrigerant compressor in accordance with one embodiment of the prior art is shown in FIG. 1. Compressor 10 includes cylindrical housing assembly 20 further including cylinder block 21, front end plate 23 at one end of cylinder block 21, crank chamber 22 enclosed within cylinder block 21 by front end plate 23, and rear end plate 24 attached to the other end of cylinder block 21. Front end plate 23 is mounted on cylinder block 21 forward of crank chamber 22 (to the left in FIG. 1) by a plurality of bolts 101. Rear end plate 24 is mounted on cylinder block 21 at its rearward end by a plurality of bolts (not shown). Valve plate 25 is disposed between rear end plate 24 and cylinder block 21.

Bearing 30 is disposed within opening 231 centrally formed in front end plate 23. Bearing 30 supports drive shaft 26 within opening 231. Bearing 31 is disposed within central bore 210 formed in cylinder block 21. Bearing 31 rotatably supports the inner end portion of drive shaft 26 within central bore 210. Cavity 220 is formed in cylinder block 21 to the rear of and adjacent to bore 210. Valve control mechanism 19 is disposed within cavity 220. Hole **220*a* is formed in cylinder block 21 and links cavity 220 and bore 210**.

Cam rotor 40 is fixed on drive shaft 26 by pin member 261 and rotates with drive shaft 26. Thrust needle bearing 32 is disposed between the inner end surface of front end plate 23 and the adjacent axial end surface of cam rotor 40. Cam rotor 40 includes arm 41 having pin member 42 extending therefrom. Sliding element 54 is disposed on drive shaft 26. Slant plate 50 includes opening 53 and is disposed adjacent to cam rotor 40. Slant plate 50 is disposed around sliding element 54 for movement thereabout to adjust the slant or incline angle of slant plate 50 with respect to a plane perpendicular to the longitudinal axis of drive shaft 26. Slant plate 50 includes arm 51 having slot 52. Cam rotor 40 and slant plate 50 are connected via pin member 42 inserted in slot 52 to create a hinged joint. Pin member 42 is slidable within slot 52 to allow adjustment of the slant angle of slant plate 50. Slant plate 50 rotates with cam rotor 40.

Wobble plate 60 is nutatably mounted on slant plate 50 through bearings 61 and 62. Sliding rod 64 is fixed between front end plate 23 and cylinder block 21. Slider 63 is attached to one peripheral end of wobble plate 60 and is slidably mounted on sliding rod 64, allowing wobble plate 60 to nutate along sliding rod 64 when cam rotor 40 rotates, but preventing rotation of wobble plate 60. Cylinder block 21 includes a plurality of pistons 71 located in a plurality of cylinder chambers 70. One piston 71 reciprocates in each cylinder chamber 70 and is connected to the peripheral end of wobble plate 60 by a corresponding connecting rod 72.

Rear end plate 24 includes centrally located discharge chamber 251 and peripheral annular suction chamber 241 located around discharge chamber 251. Valve plate 25 includes a plurality of valved suction ports 242 linking suction chamber 241 with a respective cylinder 70. Valve plate 25 also includes a plurality of valved discharge ports 252 linking discharge chamber 251 with a respective cylinder 70. Suction ports 242 and discharge ports 252 are provided with suitable reed valves (not shown) as described in U.S. Pat. No. 4,011,029 to Shimizu.

Rear end plate 24 includes inlet portion **241*a* linking suction chamber 241 with an evaporator of an external cooling circuit (not shown). Rear end plate 24 also includes outlet portion 251*a* linking discharge chamber 251 to a condenser of the cooling circuit (not shown). Gaskets 27 and 28 are disposed between cylinder block 21 and the inner surface of valve plate 25 and the outer surface of valve plate 25 and rear end plate 24, respectively. Gaskets 27 and 28 seal the mating surfaces of cylinder block 21, valve plate 25, and rear end plate 24**.

With reference to FIG. 2, valve control mechanism 19 includes cup-shaped casing member 191 having end plate 193 attached at its open end. Valve chamber 192 is enclosed within cup-shaped casing 191 by end plate 193. O-ring **19*a* is disposed between the outer surface of casing member 191 and the inner surface of cavity 220 to seal the mating surfaces of casing member 191 and cylinder block 21. A plurality of holes 19*b* are formed through casing member 191 and link valve chamber 192 with suction chamber 241 through conduit 221 formed in cylinder block 21, and hole 222 formed through valve plate 25. Therefore, valve chamber 192 is maintained at the suction chamber pressure. Bore 19*c* is formed through the closed end of casing member 191 and links valve chamber 192 to crank chamber 22 through hole 220*a*, bore 210, and gap 31*a* between bearing 31 and cylinder block 21**.

Bellows 194 is disposed in valve chamber 192 and longitudinally contracts or expands in response to the suction chamber pressure. Projection member **194*b* is attached to the rearward (rightside) end of bellows 194 and is secured within axial hole 193*a* formed through the center of end plate 193. Hemispherical valve member 194*a* is disposed at the forward end of bellows 194 and is moved into and out of a position sealing bore 19*c* in accordance with the expansion and contraction of bellows 194. Passageway 17 links crank chamber 22 and suction chamber 241, and includes gap 31*a*, bore 210, hole 220*a*, bore 19*c*, valve chamber 192, holes 19*b*, conduit 221, and hole 222. The opening and closing of passageway 17 is controlled by the contraction and expansion of bellows 194** in response to suction chamber pressure.

When the compressor is operated, drive shaft 26 is rotated by the engine of the vehicle through electromagnetic clutch 300. Cam rotor 40 rotates with drive shaft 26, rotating slant plate 50 as well, and causing wobble plate 60 to nutate. Nutational motion of wobble plate 60 reciprocates pistons 71 in their respective cylinders 70. As pistons 71 are reciprocated, refrigerant gas introduced into suction chamber 241 through inlet portion 241*a* flows into each cylinder 70 through suction ports 242 and is compressed in the cylinders. Compressed gas is discharged from cylinder 70 to discharge chamber 251 through discharge ports 252, and from discharge chamber 251 to the external cooling circuit through outlet portion 251*a*.

During operation of the compressor, the suction chamber pressure will change in response to a change in the heat load of the evaporator or to a change in the rotation speed of drive shaft 26. Additionally, the capacity of compressor 10 is dependent upon the slant angle of slant plate 50 and wobble plate 60. When the pressure in crank chamber 22 increases, the slant angle of the slant plate and the wobble plate decreases, thereby decreasing the capacity of the compressor. When the crank chamber pressure decreases, the slant angle increases, and the capacity of the compressor is increased.

Valve control mechanism 19 functions to maintain a predetermined suction chamber pressure in response to changes in the suction chamber pressure, that is, valve control mechanism 19 functions to restore the suction chamber pressure to a predetermined value when it changes. Since valve control mechanism 19 controls the link between the crank chamber and the suction chamber through passageway 17, valve control mechanism 19 controls the pressure within the crank chamber and thus functions to control the slant angle of the wobble plate and the slant plate to control the capacity of the compressor.

Valve control mechanism 19 functions in the following manner. When the suction chamber pressure exceeds a predetermined value due to an increase in the heat load of the evaporator or a decrease in the rotational speed of the compressor, bellows 194 contracts, moving hemispherical valve member 194*a* to the right in FIG. 2 and opening bore 19*c*. Crank chamber 22 is linked to suction chamber 241 causing the pressure in the crank chamber to decrease to the pressure in the suction chamber. The slant angle of slant plate 50 and wobble plate 60 is at a maximum value, and thus the capacity of compressor 10 is also maximized.

If the suction chamber pressure decreases below the predetermined value due to a decrease in the heat load of the evaporator or to an increase in the rotational speed of the compressor, bellows 194 expands, moving hemispherical valve member 194*a* to the left, closing bore 19*c*. The link between crank chamber 22 and suction chamber 241 is terminated and the pressure in crank chamber 22 gradually increases due to blow-by gas, that is, compressed refrigerant gas in cylinder chamber 70 bypassing a gap between piston 71 and the surface of cylinder chamber 70. Accordingly, the slant angle of slant plate 50 and wobble plate 60 gradually decreases, and the capacity of compressor 10 is gradually decreased as well.

However, if during operation the heat load of the evaporator is extremely large (for example when the compressor begins to operate on a hot day), the rotational speed of the compressor will be simultaneously high, and the suction pressure will be quickly reduced to below the predetermined value. Therefore, bellows 194 expands, terminating the link between the suction chamber and the crank chamber. The crank chamber pressure increases, reducing compressor displacement well before the passenger compartment temperature of the automobile is reduced sufficiently.

SUMMARY OF THE INVENTION

It is a primary object of this invention to provide a slant plate type piston compressor with a variable displacement mechanism having improved cooling characteristics.

A slant plate type compressor in accordance with the present invention includes a compressor housing having a cylinder block with a crank chamber formed therein. A front end plate at one end of the housing encloses the crank chamber. The housing includes a rear end plate at the other end. The rear end plate includes a suction chamber and a discharge chamber formed therein. A plurality of cylinders are formed in the cylinder block. A piston is slidably fitted within each of the cylinders and are reciprocated by a drive mechanism. The drive mechanism includes a drive shaft, a drive rotor coupled to the drive shaft and rotatable therewith, and a coupling mechanism coupling the rotor to the pistons, such that rotary motion of the rotor is converted into reciprocating motion of the pistons. The coupling mechanism includes a member having a surface disposed at an inclined angle relative to a plane perpendicular to the drive shaft. The inclined angle is adjustable to vary the stroke length of the reciprocating pistons in the cylinders, varying the capacity or displacement of the compressor.

First and second passageways each link the crank chamber to the suction chamber. First and second valve control mechanisms control the closing and opening of the first and second passageways, respectively, to adjust the inclined angle in response to the suction chamber pressure. The second valve control mechanism controls the closing and opening of the second passageway at first and second control points. The control points generally correspond to the suction chamber pressure. When the suction chamber pressure decreases to a level below the first control point, the link between the suction chamber and the crank chamber provided by the second passageway is terminated. When the suction chamber pressure increases to a level above the second control point, the second passageway is opened. The first valve control mechanism controls the opening and closing of the first passageway in response to the suction chamber pressure at a third control point. When the suction chamber pressure is below the third control point, the first passageway is closed. Conversely, when the suction chamber pressure is above the third control point, the first passageway is opened. The first control point corresponds to a suction chamber pressure which is lower than the suction chamber pressure corresponding to the third control point which is lower than the suction chamber pressure corresponding to the second control point. Therefore, the second valve mechanism overrides the first valve mechanism and maintains the link between the suction and crank chambers when the suction chamber pressure decreases to a level below the third control point but still above the first control point. The increase in crank chamber pressure and corresponding reduction of compressor capacity is delayed until after the passenger compartment is cooled.

Further objects, features and other aspects of this invention will be understood from the detailed description of the preferred embodiments of this invention with reference to the drawings.

DETAILED DESCRIPTION OF THE PREFERRED EMBODIMENT

Figure 1:
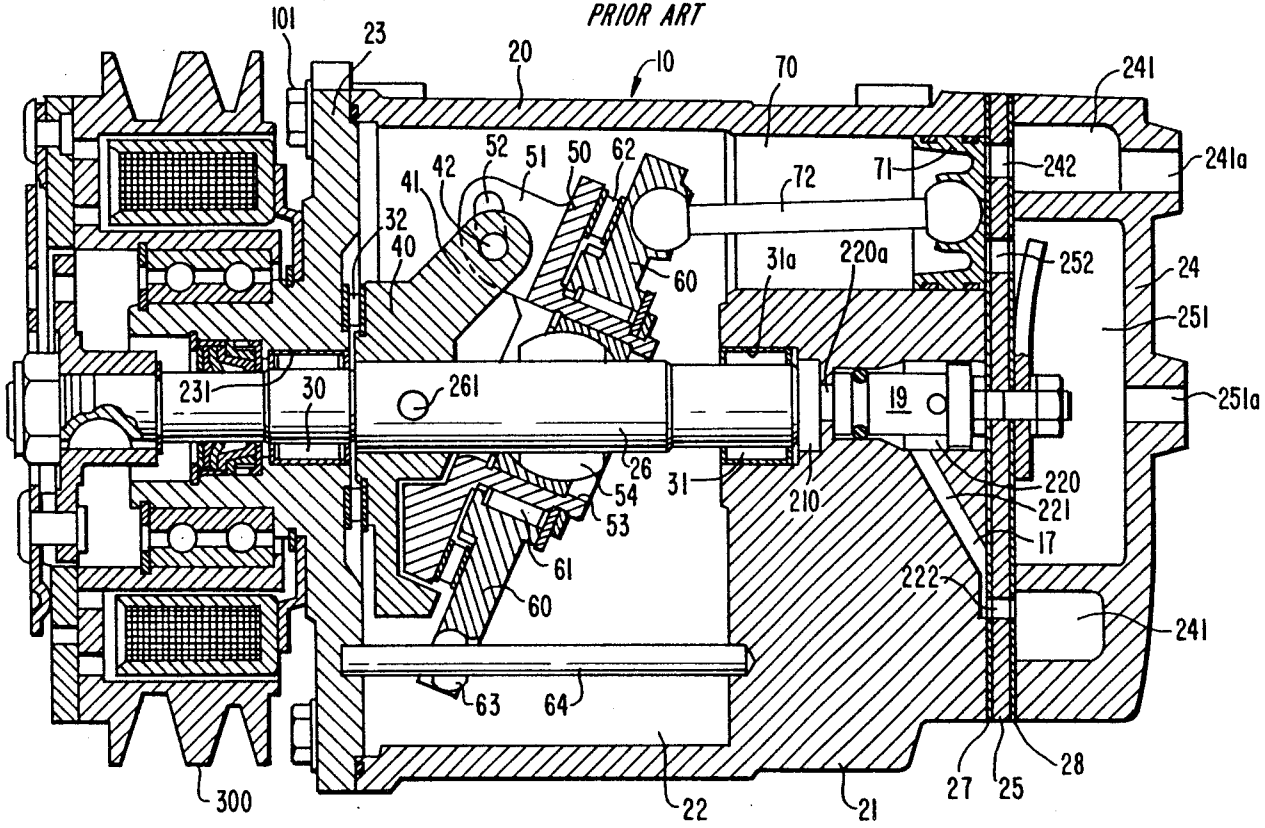
FIG. 1 PRIOR ART
FIG. 1 is a vertical longitudinal sectional view of a wobble plate type refrigerant compressor in accordance with the prior art.
Figure 2:
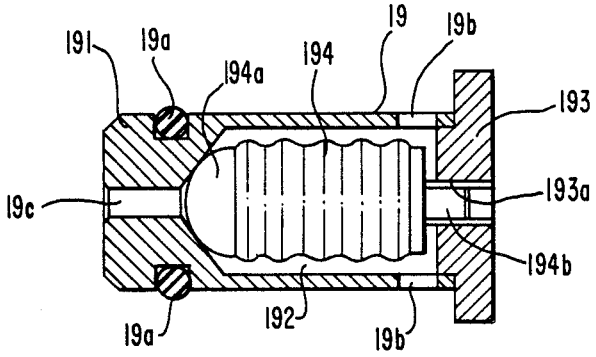
FIG. 2 PRIOR ART
FIG. 2 is an enlarged partially sectional view of a prior art valve control mechanism shown in the prior art compressor of FIG. 1.
Figure 3:
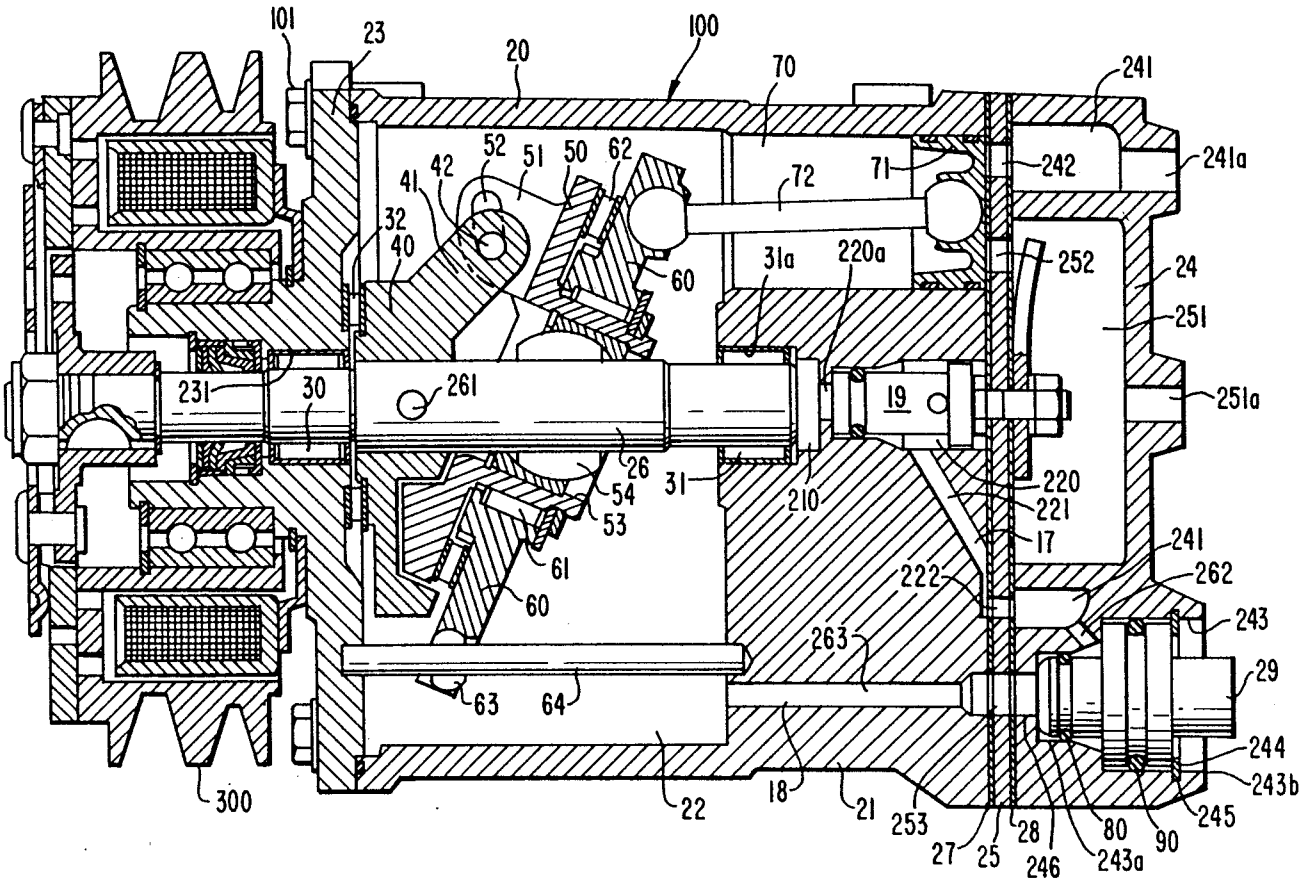
FIG. 3 is a vertical longitudinal sectional view of a wobble plate type refrigerant compressor in accordance with one embodiment of the present invention.

With reference to FIG. 3, the construction of a slant plate type compressor, specifically wobble plate type refrigerant compressor 100 in accordance with a first embodiment of the present invention is shown. Elements of the compressor shown in FIG. 3 which are identical to the prior art compressor shown in FIG. 1 are accorded like reference numerals. Accordingly, valve control mechanism 19 and passageway 17 of FIG. 1 are identical with first valve control mechanism 19 and first passageway 17 of the present invention as shown in FIG. 3. Additionally, for purposes of description only, the left side of the figure will be referenced as the forward end or front end, and the right side of the figure will be referenced as the rearward end.

Compressor 100 further includes cup-shaped opening 243 formed at a peripheral location in rear end plate 24. Opening 243 includes small diameter portion **243*a* and large diameter portion 243*b*. Second valve control mechanism 29 is fixed within opening 243 by snap ring 244 fitting within annular groove 245 formed in the inner surface of opening 243**.

Figure 4:
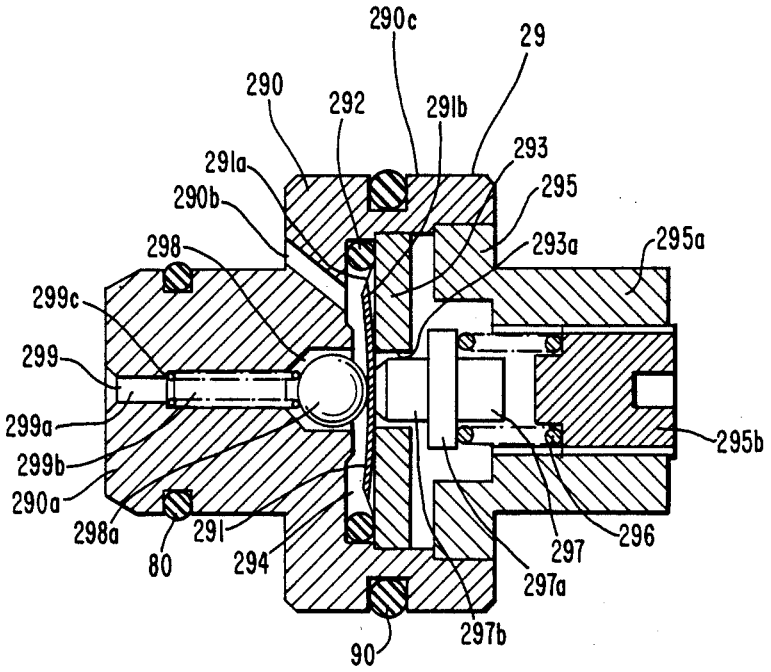
FIG. 4 is an enlarged partially sectional view of a second valve control mechanism shown in the compressor of FIG. 3.

With reference to FIG. 4, second valve control mechanism 29 includes cup-shaped casing 290 and deformable member 291 disposed therein. Cup-shaped casing 290 includes large diameter portion **290*c* having one open surface and integral smaller diameter axial projection 290*a* extending from portion 290*c*. Deformable member 291 includes circular diaphragm 291*a* and circular shaped elastic plate 291*b* attached to one side surface of diaphragm 291*a*. O-ring 292 is disposed at the inner closed end of portion 290*c* and guide plate 293 is fixedly disposed along the inner peripheral wall of casing 290 within portion 290*c*. Guide plate 293 is disposed to the rear of O-ring 292 and the peripheral side surfaces of deformable member 291 are fixed between O-ring 292 and guide plate 293. Guide plate 293 includes central opening 293*a* extending therethrough. Deformable member 291 covers opening 293*a*. Interior chamber 294 is defined within casing 290 by deformable member 291 and O-ring 292**.

The open end of portion **290*c* of casing 290 is closed by cover plate 295. Cover plate 295 is fixed within casing 290 and has central axial projection 295*a* extending therefrom. Screw 295*b* is adjustably screwed within axial projection 295. Bias spring 296 is disposed between the forward surface of screw 295*b* and rod 297. Rod 297 includes forward projection 297*b* extending through central opening 293*a* and radial projection 297*a* formed at its longitudinal center. Bias spring 296 contacts rod 297 at radial projection 297*a*. Forward projection 297*b* is biased towards the rear surface of deformable member 291 by bias spring 296. The bias force provided by bias spring 296 on deformable member 291 through rod 297 is adjustable by adjusting the position of screw 295*b* within axial projection 295*a***.

Valve seat 298 is formed within casing 290 and ball valve **298*a* is disposed in valve seat 298 forward of deformable member 291. Axial conduit 299 is centrally formed in axial projection 290*a* of casing 290 and includes small diameter portion 299*a* located forward of large diameter portion 299*b*. Conduit 299 links valve seat 298 to conduit 263 extending through cylinder block 21 and opening into crank chamber 22. Bias spring 299*c* is disposed in large diameter portion 299*b* of conduit 299, and biases ball valve 298*a* rearwardly against deformable member 291. The bias force of bias spring 299*c* is sufficient only to prevent axial floating of ball valve 298*a* within valve seat 298, that is, the bias force does not deform deformable member 291**.

Channel **290*b* is formed through casing 290. O-ring 80 is disposed between the outer peripheral surface of axial projection 290*a* and the inner peripheral surface of small diameter portion 243*a* of cup-shaped opening 243 to seal the mating surfaces therebetween. O-ring 90 is disposed between the outer peripheral surface of portion 290*c* of casing 290 and the inner peripheral surface of large diameter portion 243*b* of cup-shaped opening 243** to seal the mating surfaces therebetween.

Conduit 263 extends parallel to the axis of drive shaft 26 and through cylinder block 21, and along with opening 253 in valve plate 25, bore 246 in rear end plate 24, conduit 299, and valve seat 298, links crank chamber 22 with interior chamber 294. Channel 262 is formed in rear end plate 24 at a location adjacent casing 290 which is between O-rings 80 and 90. Channel 262 links suction chamber 241 to interior chamber 294 within casing 290 through channel **290*b*. Accordingly, deformable member 291 is responsive to suction chamber pressure on a forward side surface. Deformable member 291 is also responsive to the contact force of rod 297 on the opposite side surface. Conduit 263, opening 253, bore 246, conduit 299, valve seat 298, interior chamber 294, channel 290*b* and channel 262 form second passageway 18**.

Second passageway 18 controllably links crank chamber 22 and suction chamber 241 in response to the effect of the suction chamber pressure on deformable member 291 as discussed below.

Figure 5:
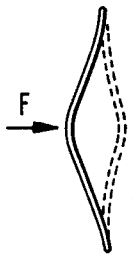
FIG. 5 is a schematic illustration showing the transformation of an elastic plate disposed in the second valve control mechanism shown in FIG. 4, wherein the solid line and the dashed line show the configuration of the elastic plate when the second passageway is closed and when the second passageway is opened, respectively.

With reference to FIG. 5 elastic plate 291*b* of deformable member 291 is made of a metal which switches between a concave and a convex configuration in response to the force or load F applied to the side surfaces thereof. (For purposes of description only, the terms concave and convex are referenced to a view from the left side of FIG. 4, that is, the solid line representation of FIG. 5 is convex and the dashed line representation is concave). The change in configuration of elastic plate 291*b* occurs rapidly and with a hysteresis effect. The force F applied to elastic plate 291*b* is the net result of the suction chamber pressure applied to the forward surface and the bias force of spring 296 applied to the rearward surface through rod 297.

Figure 6:
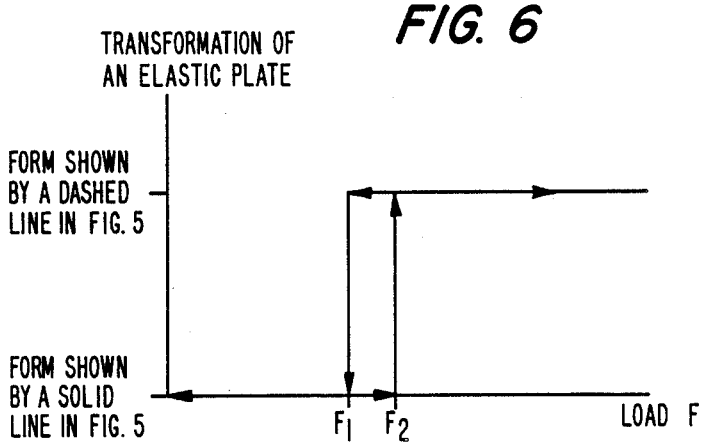
FIG. 6 is a graph showing the relation between the transformation of the elastic plate and the force on the elastic plate.

With reference to both FIGS. 5 and 6, initially when the force acting on elastic plate 291*b* is below F1, plate 291*b* has the convex form shown by the solid line in FIG. 5. Elastic plate 291*b* maintains this form so long as the force acting thereon is less than or equal to F2. When the force exceeds F2, the form of elastic plate 291*b* is rapidly changed to the concave form shown by the dashed line in FIG. 5. In this configuration, elastic plate 291*b* produces a restoring force equal to F1, that is, a force opposite load F and acting to the left in the figures. Thus, when the load acting on elastic plate 291*b* becomes less than F2 but still greater than F1, elastic plate 291*b* maintains a concave shape. When the force is reduced below $F_1$, the form of elastic plate 291*b* is rapidly restored to the convex configuration. The values for F1 and F2 may be freely determined by appropriate selection of the material of elastic plate 291*b*.

Figure 7:
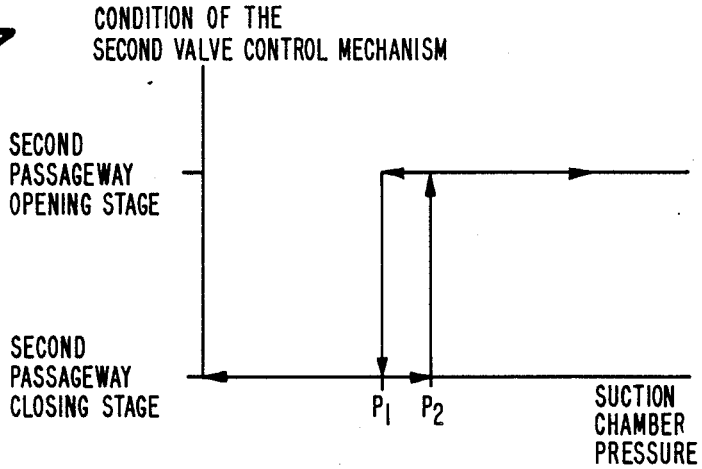
FIG. 7 is a graph showing the relation between the opening and closing of the second passageway as a function of the suction chamber pressure.

With reference to FIG. 7, second valve control mechanism 29 acts in response to suction chamber pressure to control the capacity of the compressor in accordance with the above discussion of the force or load F. The values of the suction chamber pressure in FIG. 7 generally relate to the values for the force shown in FIG. 6. Pressure $P_2$ is greater than pressure $P_1$ and force F2 is greater than force F1. The values for the suction chamber pressure $P_1$ and $P_2$ act as control points. The correspondence between the control points and the suction chamber pressure may be adjusted for a given composition of elastic plate 291*b* by shifting the position of screw 295*b* within projection 295*a* to change the effective force of bias spring 296 on the rear surface of deformable member 291. When the suction chamber pressure is below the first control point $P_1$, deformable member 291 assumes the shape shown by the solid line FIG. 5. In this position, the surface of deformable member 291 forces ball valve 298*a* forward in valve seat 298 against the small biasing force of spring 299*c*. Therefore, ball valve 298*a* closes valve seat 298, closing second passageway 18 and isolating crank chamber 22 from suction chamber 241. If the suction chamber pressure increases to a level higher than second control point $P_2$, deformable member 291 quickly assumes the shape shown in the dashed line in FIG. 5, and also shown in FIG. 4. Ball valve 298*a* moves to the right under the bias provided by spring 299*c* and valve seat 298 is opened, opening second passageway 18 and linking suction chamber 241 with crank chamber 22.

The link between suction chamber 241 and crank chamber 22 through passageway 18 is maintained until the suction chamber pressure decreases to a level below first control point $P_1$. If the pressure is once again reduced below control point $P_1$, elastic plate 291*b* quickly assumes a convex shape and ball valve 298*a* is forced to the left, closing valve seat 298. Passageway 18 is closed terminating the link between crank chamber 22 and suction chamber 241.

Furthermore, first valve control mechanism 19 disposed in cavity 220 functions in the same manner as described with respect to the prior art compressor of FIG. 1. Bellows element 194 of first valve control mechanism 19 is responsive at a third control point $P_3$ corresponding to the suction pressure. First control point $P_1$ is less than third control point $P_3$ which is less than second control point $P_2$. Passageway 17 is closed when the suction pressure is below third control point $P_3$ and is opened when the suction pressure is above third control point $P_3$.

In operation, if wobble plate type refrigerant compressor 100 is used for an automotive air-conditioning system and compressor 100 is started under an extremely high heat load, compressor 100 operates at maximum displacement due to the fact that the suction chamber pressure exceeds second control point $P_2$. Both first and second passageways 17 and 18 are open, linking crank chamber 22 with suction chamber 241. In response, the suction chamber pressure is rapidly reduced. When the suction chamber pressure is reduced below third control point $P_3$, bellows element 194 of first valve control mechanism 19 expands as in the prior art, terminating the link of crank chamber 22 with suction chamber 241 through first passageway 17. However, the compressor will continue to operate at maximum capacity because crank chamber 22 and suction chamber 241 are still linked through second passageway 18 since the suction pressure has not been reduced to a level below first control point $P_1$ and thus second valve control mechanism 29 will not act to close second passageway 18. In this manner, second valve control mechanism 29 overrides the action of first valve control mechanism 19.

When the suction chamber pressure is reduced below the first control point $P_1$, second passageway 18 is closed due to the action of deformable member 291 of second valve control mechanism 29. Therefore, the link between crank chamber 22 and suction chamber 241 is terminated, and compressor 100 functions at reduced displacement as the crank chamber pressure builds due to blow-by gas. After the second valve control mechanism 29 closes second passageway 18, the displacement of compressor 100 is substantially controlled only by first valve control mechanism 19 in response to the suction chamber pressure since second passageway 18 is closed and remains closed until the suction chamber pressure exceeds second control point $P_2$.

Figure 8:
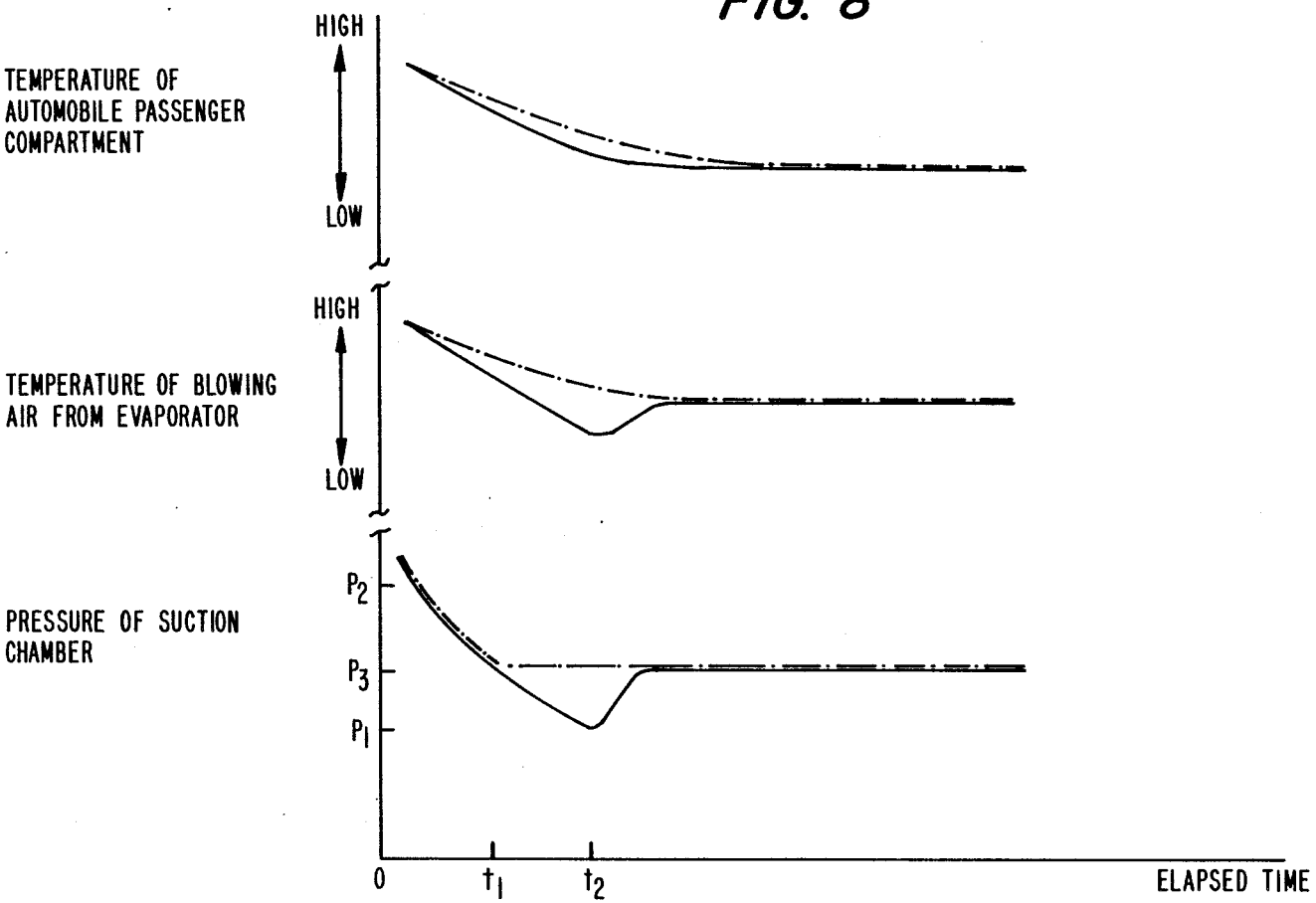
FIG. 8 is a graph comparing the cooling characteristics of a compressor in accordance with the present invention and a compressor in accordance with the prior art, wherein, the solid line shows the present invention and the dot-dash line shows the prior art.

With reference to FIG. 8, the cooling characteristics of the compressor in accordance with the invention and a compressor in accordance with the prior art are shown. The compressors are both used in an automotive air conditioning system operating under a high heat load and at a high rotation speed. The solid line represents the present invention and the dash-dot line represents the prior art. The graph of FIG. 8 shows the suction chamber pressure, the temperature of the air blowing from the evaporator, and the temperature of the air in the automobile passenger compartment, all graphed with respect to elapsed time after the compressor begins operation. In the present invention, the compressor operates at maximum displacement until the suction chamber pressure decreases below the first control point $P_1$ which is lower than third control point $P_3$ of the compressor of the prior art. Accordingly, the temperature of the automobile passenger compartment is reduced faster in the present invention as can be seen in the uppermost graph.

Figure 10:
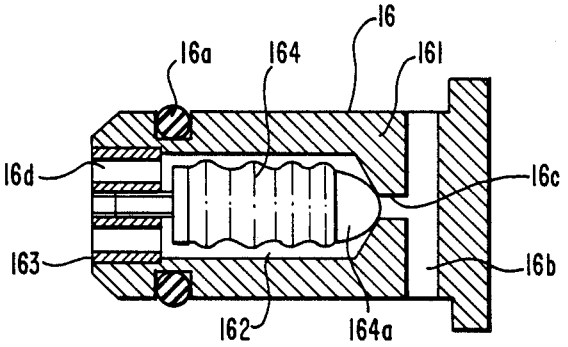
FIG. 10 is an enlarged partially sectional view of a second embodiment of the first valve control mechanism shown in the compressor of FIG. 9.
Figure 9:
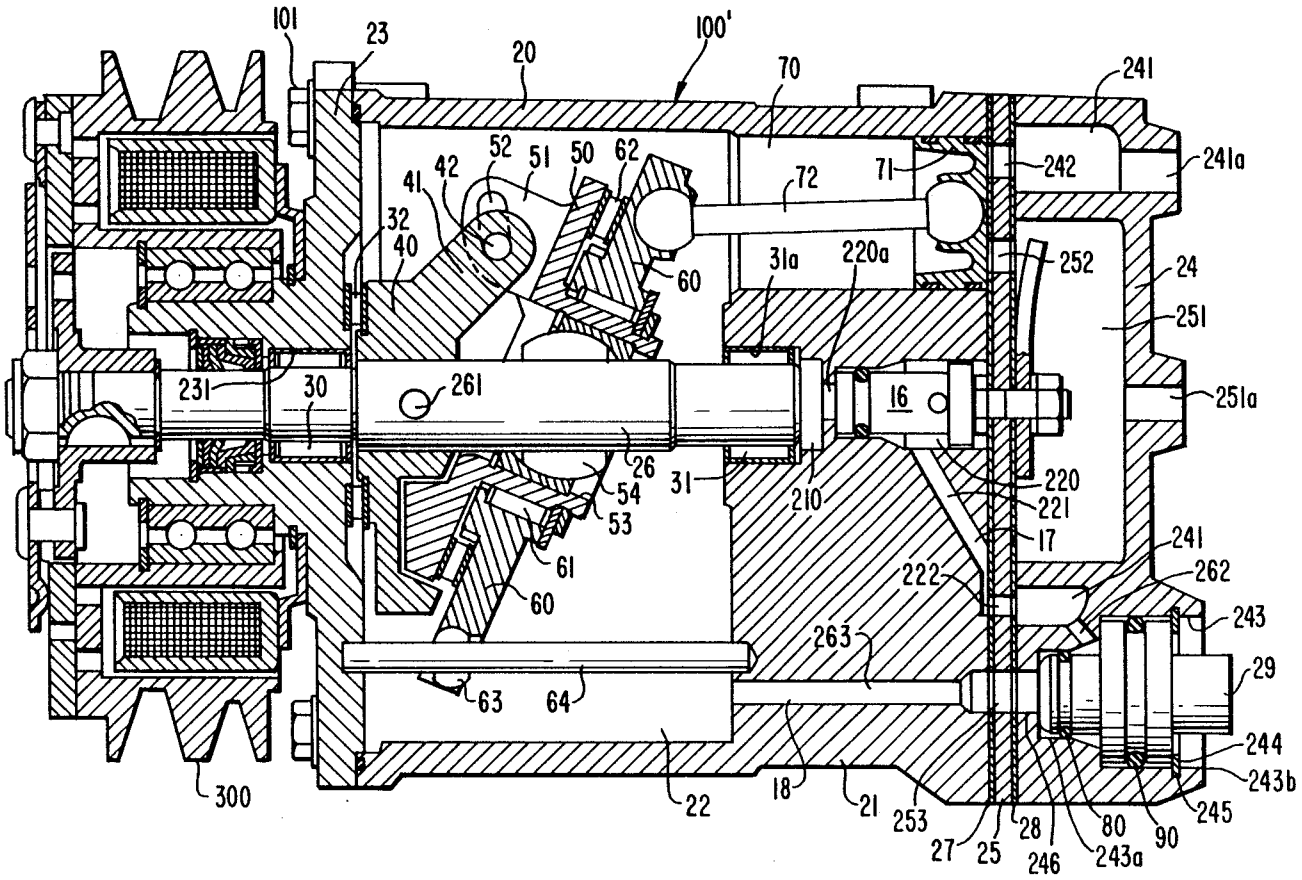
FIG. 9 is a vertical longitudinal sectional view of a wobble plate type refrigerant compressor in accordance with a second embodiment of the present invention.

As shown in the present invention, the first valve control mechanism operates in response to suction chamber pressure. However, the first valve control mechanism may be easily modified so that it operates in response to crank chamber pressure. With reference to FIGS. 9 and 10, the construction of a slant plate type compressor in accordance with a second embodiment of the present invention is shown. Elements of the compressor shown in FIG. 9 which are identical to the compressor shown in the first embodiment of FIG. 3 are accorded like reference numerals. Accordingly, compressor 100' includes first valve control mechanism 16 disposed in first passageway 17 and responsive to the crank chamber pressure. First valve control mechanism 16 includes cup-shaped casing member 161 having bellows supporting plate 163 disposed on an interior surface at one end of casing member 161. Bellows supporting plate 163 encloses valve chamber 162 within cup-shaped casing 161. O-ring **16*a* is disposed between the outer surface of casing member 161 and the inner surface of cavity 220 to seal the mating surfaces of casing member 161 and cylinder block 21. Bellows 164 is supported in valve chamber 162 by bellows supporting plate 163 at one end. Hemispherical valve member 164*a* is disposed at the opposite end of bellows 164**.

Hole **16*c* is formed through an interior surface of casing 161 and links valve chamber 162 to conduit 16*b* also formed within casing member 161. Hemispherical valve member 164*a* is adjacent hole 16*c*. Conduit 16*b* links valve chamber 162 to suction chamber 241 through conduit 221. Additionally, bellows supporting plate 163 includes a plurality of conduits 16*d* formed therethrough linking valve chamber 162 with crank chamber 22 through hole 220*a*, bore 210, and gap 31*a* between bearing 31 and cylinder block 21. The opening and closing of passageway 17 is controlled by the contraction and expansion of bellows 164** in direct response to the crank chamber pressure.

Bellows 164 is responsive at a third control point $P_3'$ corresponding to a predetermined crank chamber pressure and generally relating to the suction chamber pressure. As in the first embodiment, the first control point $P_1$ is less than third control point $P_3'$ which is less than second control point $P_2$. In operation, the compressor of the second embodiment functions similarly to the compressor of the first embodiment except that first valve control mechanism 16 is responsive to crank chamber pressure instead of suction chamber pressure.

This invention has been described in detail in connection with the preferred embodiments. These embodiments, however, are merely for example only and the invention is not restricted thereto. It will be understood by those skilled in the art that other variations and modifications can easily be made within the scope of this invention as defined by the appended claims.

I claim:

1. In a slant plate type refrigerant compressor including a compressor housing having a cylinder block, a front end plate at one end of said cylinder block and a rear end plate at the other end of said cylinder block, said cylinder block having a plurality of cylinders therein, a crank chamber enclosed within said compressor housing, a piston slidably fitted within each of said cylinders, a drive mechanism coupled to said pistons to reciprocate said pistons within said cylinders, said drive mechanism including a drive shaft rotatably supported in said housing, a rotor coupled to said drive shaft and rotatable with said drive shaft, and coupling means coupling said rotor to said pistons for converting rotary motion of said rotor into reciprocating motion of said pistons, said coupling means having a surface disposed at an inclined angle relative to a plane perpendicular to said drive shaft, said angle adjustable to vary the stroke length of said pistons and the capacity of said compressor, said rear end plate having a suction chamber and a discharge chamber, first and second passageways each linking said crank chamber to said suction chamber, and first and second valve control means for controlling the link of said crank chamber to said suction chamber through said first and said second passageways, respectively, to adjust the inclined angle in response to suction chamber pressure, the improvement comprising:

said second valve control means controlling said link of said suction chamber to said crank chamber through said second passageway at a first and at a second control point corresponding to a first and a second value, respectively, of the suction chamber pressure, said second valve control means closing said second passageway when the suction chamber pressure is below the first control point, said second valve control means opening said second passageway when the suction chamber pressure is above the second control point, and said first valve control means controlling the link of said suction chamber to said crank chamber through said first passageway at a third control point corresponding to a third value of the suction chamber pressure, said first valve control means opening said first passageway when the suction chamber pressure is above the third control point and closing said first passageway when the suction chamber pressure is below the third control point, the first control point being less than the third control point, the third control point being less than the second control point.

2. The compressor recited in claim 1 further comprising control point adjusting means for adjusting the correspondence between the first and the second control points and the suction chamber pressure.

3. The compressor recited in claim 1, said second valve control means including a deformable member hysteretically responsive to the suction chamber pressure on one surface to deform said deformable member between at least a first and a second shape, and a valve member controlling the opening and closing of said second passageway, said deformable member acting on said valve member and moving said valve member to a position closing said second passageway when the suction pressure is below the first control point, said deformable member allowing said valve member to move to a position in which said second passageway is open when the suction pressure is above the second control point.

4. The compressor recited in claim 3, said second valve control means further including a biasing spring to move said valve member to a position in which said second passageway is open when the suction chamber pressure is above the second control point.

5. The compressor recited in claim 3, said deformable member including an elastic metal plate responsive to suction chamber pressure on one side surface thereof, said metal plate deformable between said first and said second shape in a hysteresis manner in response to the suction chamber pressure acting on said one side surface.

6. The compressor recited in claim 5, said metal plate assuming a concave shape with respect to said side responding to the suction chamber pressure to allow said second passageway to be opened to link said suction chamber with said crank chamber when the suction chamber pressure exceeds the second control point, said metal plate assuming a convex shape with respect to the side responding to the suction chamber pressure when the suction chamber pressure is below the first control point to close said second passageway, said metal plate responsive to the suction chamber pressure to undergo deformation between said concave shape and said convex shape in a hysteresis manner with respect to said second control point and said first control point, respectively.

7. The compressor recited in claim 6, said second valve control means further comprising control point adjusting means for adjusting the correspondence between the first and the second control points and the suction chamber pressure.

8. The compressor recited in claim 7, said control point adjusting means including a rod adjacent said deformable member on a surface opposite said surface responding to the suction chamber pressure, and an adjustably positionable biasing spring acting on said rod to bias said rod into contact with said opposite surface.

9. In a slant plate type refrigerant compressor including a compressor housing having a cylinder block, a front end plate at one end of said cylinder block and a rear end plate at the other end of said cylinder block, said cylinder block having a plurality of cylinders therein, a crank chamber enclosed within said compressor housing, a piston slidably fitted within each of said cylinders, a drive mechanism coupled to said pistons to reciprocate said pistons within said cylinders, said drive mechanism including a drive shaft rotatably supported in said housing, a rotor coupled to said drive shaft and rotatable with said drive shaft, and coupling means coupling said rotor to said pistons for converting rotary motion of said rotor into reciprocating motion of said pistons, said coupling means having a surface disposed at an inclined angle relative to a plane perpendicular to said drive shaft, said angle adjustable to vary the stroke length of said pistons and the capacity of said compressor, said rear end plate having a suction chamber and a discharge chamber, first and second passageways each linking said crank chamber to said suction chamber, and first and second valve control means for controlling the link of said crank chamber to said suction chamber through said first and said second passageways, respectively, said first valve control means directly responsive to crank chamber pressure and said second valve control means directly responsive to suction chamber pressure, to adjust the inclined angle of said surface, the improvement comprising:

said second valve control means controlling said link of said suction chamber to said crank chamber through said second passageway at a first and at a second control point corresponding to a first and a second value, respectively, of the suction chamber pressure, said second valve control means closing said second passageway when the suction chamber pressure is below the first control point, said second valve control means opening said second passageway when the suction chamber pressure is above the second control point, and said first valve control means controlling the link of said suction chamber to said crank chamber through said first passageway at a third control point corresponding to a predetermined crank chamber pressure and relating to a third value of the suction chamber pressure, said first valve control means opening said first passageway when the suction chamber pressure is above the third control point and closing said first passageway when the suction chamber pressure is below the third control point, the first control point being less than the third control point, the third control point being less than the second control point.

10. The compressor recited in claim 9 further comprising control point adjusting means for adjusting the correspondence between the first and the second control points and the suction chamber pressure.

11. The compressor recited in claim 9, said second valve control means including a deformable member hysteretically responsive to the suction chamber pressure on one surface to deform said deformable member between at least a first and a second shape, and a valve member controlling the opening and closing of said second passageway, said deformable member acting on said valve member and moving said valve member to a position closing said second passageway when the suction pressure is below the first control point, said deformable member allowing said valve member to move to a position in which said second passageway is open when the suction pressure is above the second control point.

12. The compressor recited in claim 11, said second valve control means further including a biasing spring to move said valve member to a position in which said second passageway is open when the suction chamber pressure is above the second control point.

13. The compressor recited in claim 11, said deformable member including an elastic metal plate responsive to suction chamber pressure on one side surface thereof, said metal plate deformable between said first and said second shape in a hysteresis manner in response to the suction chamber pressure acting on said one side surface.

14. The compressor recited in claim 13, said metal plate assuming a concave shape with respect to said side responding to the suction chamber pressure to allow said second passageway to be opened to link said suction chamber with said crank chamber when the suction chamber pressure exceeds the second control point, said metal plate assuming a convex shape with respect to the side responding to the suction chamber pressure when the suction chamber pressure is below the first control point to close said second passageway, said metal plate responsive to the suction chamber pressure to undergo deformation between said concave shape and said convex shape in a hysteresis manner with respect to said second control point and said first control point, respectively.

15. The compressor recited in claim 14, said second valve control means further comprising control point adjusting means for adjusting the correspondence between the first and the second control points and the suction chamber pressure.

16. The compressor recited in claim 15, said control point adjusting means including a rod adjacent said deformable member on a surface opposite said surface responding to the suction chamber pressure, and an adjustably positionable biasing spring acting on said rod to bias said rod into contact with said opposite surface. between the suction chamber and the crank chamber. The second control device acts as an override with respect to the first valve device to maintain a link between the suction and crank chambers after the suction chamber pressure is reduced below the second control point.

* * * * *